United States Patent [19]

Rothenberg

[11] 4,324,380

[45] Apr. 13, 1982

[54] MOUNTING PIN

[76] Inventor: Bruce J. Rothenberg, 200 B Rutledge St., San Francisco, Calif. 94110

[21] Appl. No.: 118,449

[22] Filed: Feb. 4, 1980

[51] Int. Cl.[3] ..... A47H 1/16

[52] U.S. Cl. ..... 248/302; 248/214; 24/345; 211/106; 211/119; 211/181

[58] Field of Search ..... 248/302, 214, 489; 211/106, 112, 119, 181; 24/345, 349, 361, 366, 355

[56] References Cited

U.S. PATENT DOCUMENTS

| | | | |
|---|---|---|---|
| 727,852 | 5/1903 | Sharp et al. | 211/106 X |
| 1,039,367 | 9/1912 | Dehn | 248/302 X |
| 1,308,253 | 7/1919 | Oftedahl | 248/302 X |
| 1,734,653 | 11/1929 | Talisman | 24/355 |
| 3,430,301 | 3/1969 | Venus | 248/489 X |
| 3,722,844 | 3/1973 | Baker | 248/302 |

*Primary Examiner*—H. Hampton Hunter
*Attorney, Agent, or Firm*—Robert Charles Hill

[57] ABSTRACT

A mounting pin suitable for use in hanging various objects to a projecting wall device is provided with a long run, a short run extending perpendicular from the long run, an inner run extending 180° from the short run, and a final run extending perpendicular from the inner run. Once through the desired object, the mounting pin is bent to conform to the projecting wall device.

8 Claims, 4 Drawing Figures

FIGURE 1
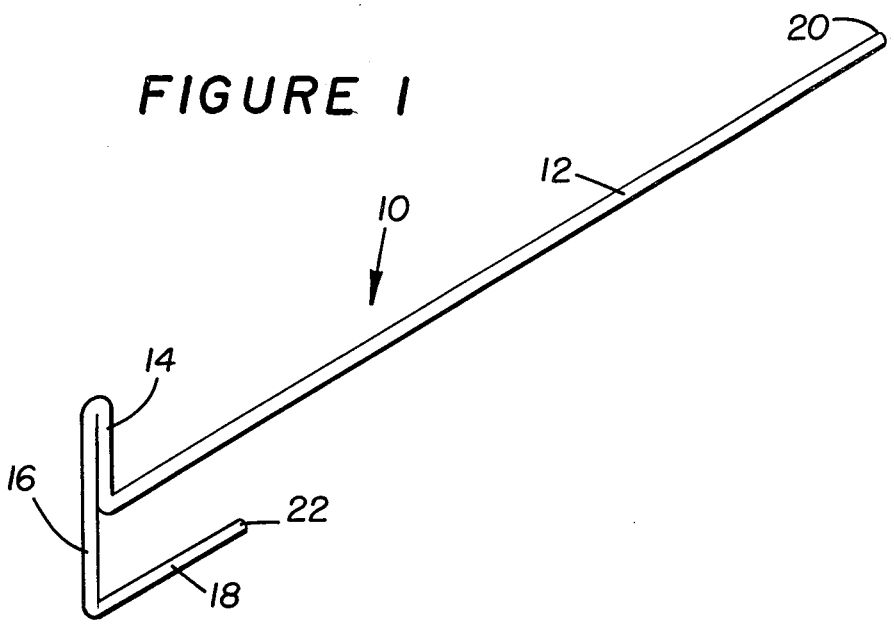
FIGURE 2
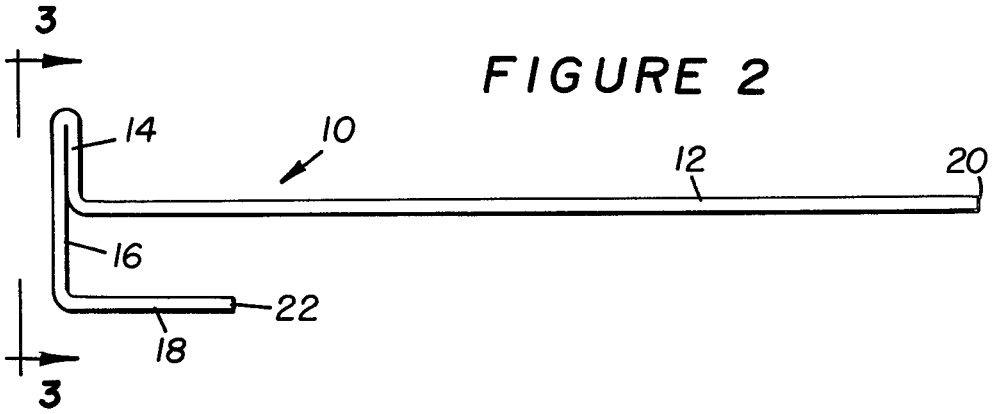
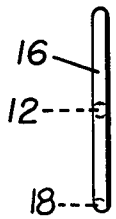
FIGURE 3

MOUNTING PIN

BACKGROUND OF THE INVENTION

A mounting pin has a long run and a final run both of which pass through a desired object. The long run can be used to attach the object to a projecting wall device.

SUMMARY OF THE INVENTION

Until the past few years, house plants were grown in ceramic or plastic pots. The recent emphasis on bringing the outdoors inside, thereby making ones home more natural looking, has resulted in efforts to grow house plants in more natural surroundings.

Epiphyte plants grow directly on trees needing no soil. Indoor gardeners have found that these epiphytes will grow indoors if securely attached to even tree parts, e.g., bark, branches or driftwood. A fine mist of water directed to the leaf keeps the plant growing. Bromeliads, a type of epiphyte, all varieties of which flower, are successfully grown indoors by thousands of indoor plant enthusiasts.

Frequently, gardeners try to attach the tree parts to a wall, so that these striking plants are at eye level. Up to now, however, these efforts have been jerry-built as well as time consuming.

The present invention quickly and easily pierces tree pieces. Additionally, two prongs penetrate the wood, thereby preventing any twisting or rotation of the tree part. Further, the long run is easily bent to fit onto a protruding nail or other device so that the plant can then be hung onto the wall as easily as a picture frame.

It is the primary object of the present invention to provide a new and improved mounting pin.

Another object is to provide a mounting pin which easily pierces the desired object and eliminates any twisting once the object is hung on a wall.

A further object of the invention is to provide structure of the character described which is economical to produce and long lasting in usage.

BRIEF DESCRIPTION OF THE DRAWINGS

FIG. 1 is a perspective view of the mounting pin of the present invention.

FIG. 2 is a side view of the mounting pin.

FIG. 3 is a front view of the mounting pin.

DESCRIPTION OF THE PREFERRED EMBODIMENT

Figure 4:
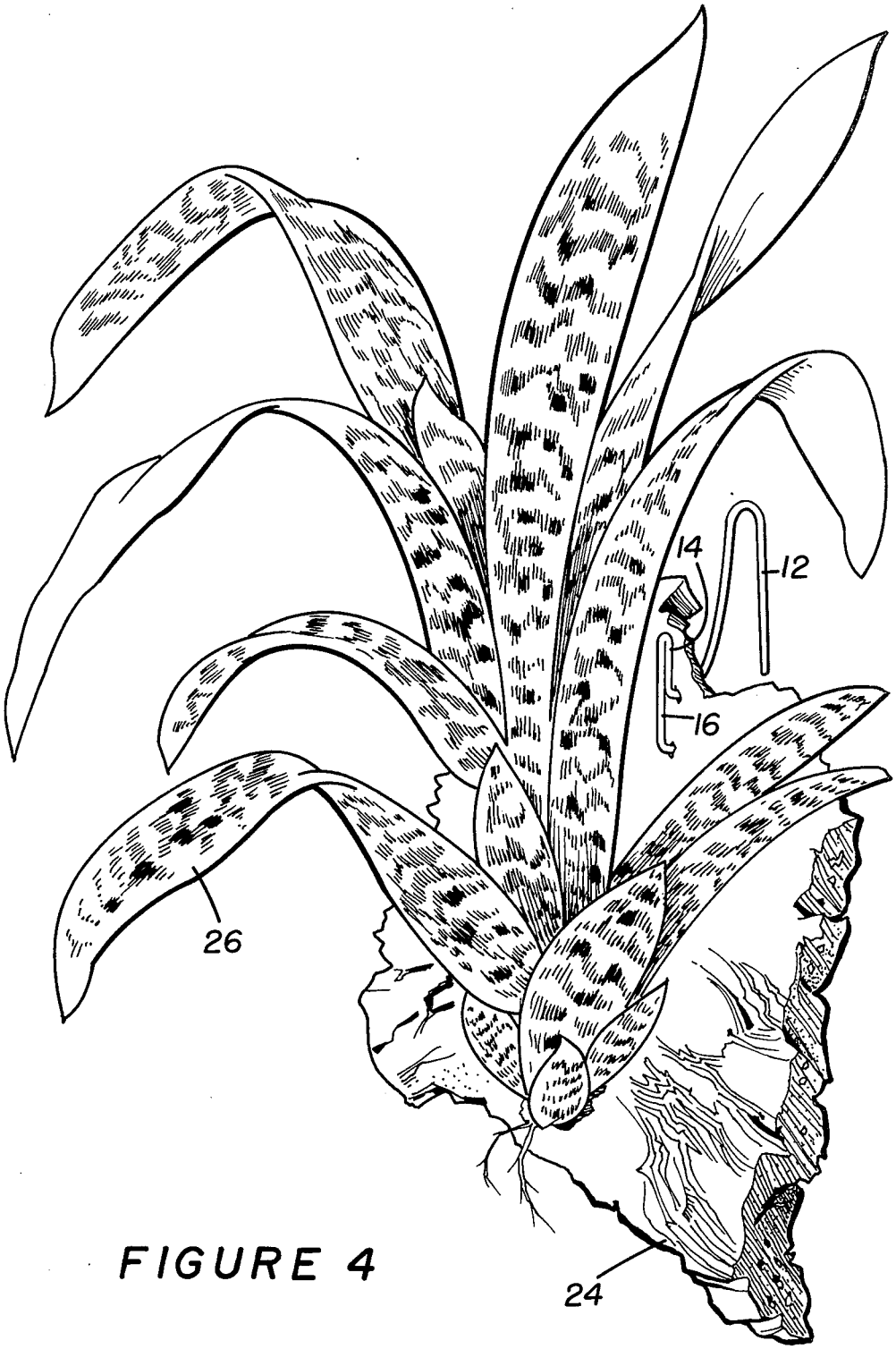
FIG. 4 is a perspective view of a piece of bark having an epiphytic plant thereon with the mounting pin inserted therethrough ready for wall mounting.

Referring to FIGS. 1 through 3 of the drawings, there is shown the mounting pin of this invention, generally indicated 10, which is adaptable for hanging various objects to a projecting wall device. The mounting pin 10 has a long run 12, a short run 14 extending perpendicular from the long run 12, an inner run 16 extending 180° from the short run 14, and a final run 18 extending perpendicular from the inner run 16. Sharp edge 20 on long run 12 and sharp edge 22 in final run 18 aid in piercing the desired object. As shown in FIG. 3, all of the runs may be in the same plane.

There are other relationships which are of interest in the mounting pin 10. Thus, it can be seen that inner run 16 is bent back over or superjacent the short run 14. Also, the final run 18 is parallel to the long run 12 and approximately 1/5 the length thereof. In addition, the inner run 16 is approximately the same length as the final run 18 and both of these runs are approximately twice the length of the short run 14.

The mounting pin 10 should be constructed of a lightweight durable material which is somewhat bendable, such as stainless steel or some other metal alloy or a suitable plastic.

A typical usage of the mounting pin 10 is shown in FIG. 4 wherein a mounting and growing medium 24 such as virgin cork bark, driftwood or tree branches or the like, is provided with an epiphyte 26 such as bromeliads, orchids, anthericums or ferns attached thereto by suitable means (not shown) such as glue, nylon strips, wires, pins, staples or the like. The long run 12 and final run 18 of mounting pin 10 are inserted through the growing medium 24 so that the short run 14 and inner run 16 are close to the front surface of the medium 24. The excess of final run 18 protruding through the medium 24 can be either cut off by suitable means or inserted back into the medium 24 while the excess of long run 12 is bent in a desired manner to attach to or on a projecting wall device (not shown) so as to be hung upon a wall for decoration.

It will be obvious that numerous modifications and variations are possible for the above described mounting pin 10 within the scope of the present invention. The foregoing description, as setting forth various constructional and operational details for purposes of understanding only, is not to be taken as limiting the scope of the present invention which is defined only by the following claims.

I claim:

1. A mounting pin, comprising (a) a straight long run, (b) a straight short run extending perpendicular from said long run (c) a straight inner run extending 180° from said short run and in touching relationship thereto, and (d) a straight run extending perpendicular from said inner run.

2. The mounting pin of claim 1 wherein the inner run is superjacent the short run.

3. The mounting pin of claim 1 wherein the final run is parallel to the long run.

4. The mounting pin of claim 1 wherein the final run terminates in a sharp edge.

5. The mounting pin of claim 1 wherein the short run is approximately one-half the length of the inner run.

6. The mounting pin of claim 1 wherein the inner run is approximately the same length as the final run.

7. The mounting pin of claim 1 wherein the long run is approximately five times the length of the final run.

8. The mounting pin of claim 1 wherein the long run terminates in a sharp edge.

* * * * *